US008965001B2

(12) United States Patent
Kang

(10) Patent No.: US 8,965,001 B2
(45) Date of Patent: Feb. 24, 2015

(54) MIC RUBBER APPARATUS FOR PORTABLE ELECTRIC DEVICE

(75) Inventor: Boo-Hyun Kang, Suwon-si (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 1205 days.

(21) Appl. No.: 12/470,603

(22) Filed: May 22, 2009

(65) Prior Publication Data

US 2010/0074454 A1 Mar. 25, 2010

(30) Foreign Application Priority Data

Sep. 22, 2008 (KR) ..... 10-2008-0092891

(51) Int. Cl.

| | |
|---|---|
| ***H04R 1/02*** | (2006.01) |
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 1/08*** | (2006.01) |
| ***H04R 1/04*** | (2006.01) |

(52) U.S. Cl.

CPC ..... *H04R 1/086* (2013.01); *H04R 1/04* (2013.01); *H04R 1/021* (2013.01); *H04R 1/08* (2013.01); *H04R 1/083* (2013.01); *H04R 2201/02* (2013.01)

USPC ..... 381/91; 381/355; 381/369

(58) Field of Classification Search

CPC ..... H04R 1/08; H04R 1/083; H04R 1/086; H04R 1/04; H04R 1/021; H04R 2201/02

USPC ..... 381/91, 355, 369

See application file for complete search history.

(56) References Cited

U.S. PATENT DOCUMENTS

| | | | | |
|---|---|---|---|---|
| 7,251,341 | B2 * | 7/2007 | Epping et al. | 381/361 |
| 8,406,825 | B2 * | 3/2013 | Huang et al. | 455/575.1 |
| 2008/0069390 | A1 * | 3/2008 | Liu et al. | 381/365 |
| 2013/0182880 | A1 * | 7/2013 | Huang et al. | 381/365 |

FOREIGN PATENT DOCUMENTS

KR 20-1998-0010027 U 4/1998

* cited by examiner

*Primary Examiner* — Phat X Cao
*Assistant Examiner* — Diana C Vieira
(74) *Attorney, Agent, or Firm* — Cha & Reiter, LLC.

(57) ABSTRACT

A microphone rubber apparatus mounted on an SMD microphone prepared on a printed circuit board to protect the SMD microphone from an external physical impact and the like in a portable communication device such as a portable terminal and a Personal Digital Assistant (PDA). The microphone rubber apparatus includes a microphone holder portion formed to engage with and wrap up a microphone, a connection portion protruding to one side of the microphone holder portion and delivering a transmission sound to the microphone through an inside thereof, and at least one shock absorbing portion deformably formed around the connection portion to ease an impact caused by an external force. Thus, the shock absorbing portion having a wrinkled shape can be deformed no matter in which direction an impact is applied to the portable communication device, thereby easing the impact and preventing the microphone rubber from being detached from the microphone due to the external impact or during a distribution test.

11 Claims, 4 Drawing Sheets

MIC RUBBER APPARATUS FOR PORTABLE ELECTRIC DEVICE

PRIORITY

This application claims the benefit under 35 U.S.C. §119 (a) of a Korean Patent Application filed in the Korean Intellectual Property Office on Sep. 22, 2008 and assigned Serial No. 10-2008-0092891, the entire disclosure of which is hereby incorporated by reference.

BACKGROUND OF THE INVENTION

1. Field of the Invention

The present invention relates generally to a portable communication device such as a portable terminal and a Personal Digital Assistant (PDA). More particularly, the present invention relates to a microphone rubber apparatus mounted on a Surface Mounted Device (SMD) microphone prepared on a printed circuit board to protect the SMD microphone from an external physical impact and the like.

2. Description of the Related Art

A portable communication device, including a portable terminal, an MP3 player, a Personal Media Player (PMP) and a PDA, is a device with which a user can access a variety of contents while carrying it with him or her.

The portable communication device has a tendency toward multifunction and miniaturization in line with consumer demands.

Normally, a microphone is installed in the portable communication device such as the portable terminal and the PDA to conduct transmission of speech during a call. To mount the microphone on a printed circuit board, a microphone lead is formed on a lower end of the microphone and soldered onto the printed circuit board. However, the heat delivered to the printed circuit board during the soldering may deform a Polyethylene Terephthalate (PET) film, which is a vibration film, in the microphone, deteriorating a characteristic of the microphone.

Recently, circuits for ensuring a frequency characteristic of a microphone mounted in the portable communication device and cutting off electrostatics from the exterior are formed by an SMD technique, thereby removing a need for separate works and improving work efficiency for microphone installation. In this technique, all sorts of circuits for controlling and/or protecting a basic characteristic of the microphone are formed in one body, increasing space efficiency during forming of peripheral circuits of the microphone. Such an SMD microphone is easy to install and can prevent an echo phenomenon and a decrease in radiation performance, which may occur while the microphone is soldered onto the printed circuit board.

A microphone rubber is mounted on the SMD microphone to protect the microphone from an external impact or the like and prevent the echo phenomenon. The microphone rubber may remarkably reduce a possible breakaway of the microphone even though an external force such as an impact is applied to the portable communication device.

However, since a structure of this microphone is exposed to an inner side of a terminal, capability of the microphone may be affected by noise, heat, sound and the like inside the portable communication device, causing a decrease in transmission sensitivity.

In addition, a groove having a tolerance slightly less than a size of the microphone is formed in the microphone rubber so that the microphone rubber may wrap up the microphone. Thus, the microphone can be fit into the groove. However, when a user drops the terminal by mistake or applies an impact thereto, the microphone rubber may be separated from the microphone.

Though the microphone rubber closely adheres to the SMD microphone, the microphone may occasionally be detached from the microphone rubber during a distribution test. To address this problem, use of the SMD microphone is prohibited during the distribution test or soldering points of the microphone are added, but this may lead to the cost increase and production delay. Further, the microphone may be deformed or out of order due to an impact applied thereto while the microphone rubber is separated from the microphone.

Accordingly, there is a long-felt need for a microphone rubber apparatus for a portable communication device, capable of preventing a microphone rubber from being detached from a microphone due to an external impact applied to the portable communication device, and of easing or absorbing the impact. Also, there is a need for a microphone rubber that exerts no influence on an SMD microphone during the distribution test.

SUMMARY OF THE INVENTION

An aspect of the present invention is to address at least the above-mentioned problems and/or disadvantages and to provide at least the advantages described below. Accordingly, an aspect of the present invention provides a microphone rubber apparatus having a plurality of wrinkled recesses at one end of a microphone rubber to ease or absorb an impact applied from the exterior in a portable communication device.

In accordance with one aspect of the present invention, a microphone rubber apparatus for a portable communication device is provided. The microphone rubber apparatus includes a microphone holder portion formed to engage with and wrap up a microphone; a connection portion protruding to one side of the microphone holder portion and delivering a transmission sound to the microphone through an inside thereof; and at least one shock absorbing portion deformably formed around the connection portion to ease an impact caused by an external force.

BRIEF DESCRIPTION OF THE DRAWINGS

The above and other aspects, features and advantages of certain exemplary embodiments of the present invention will be more apparent from the following description taken in conjunction with the accompanying drawings, in which.

DETAILED DESCRIPTION OF EXEMPLARY EMBODIMENTS

Figure 1:
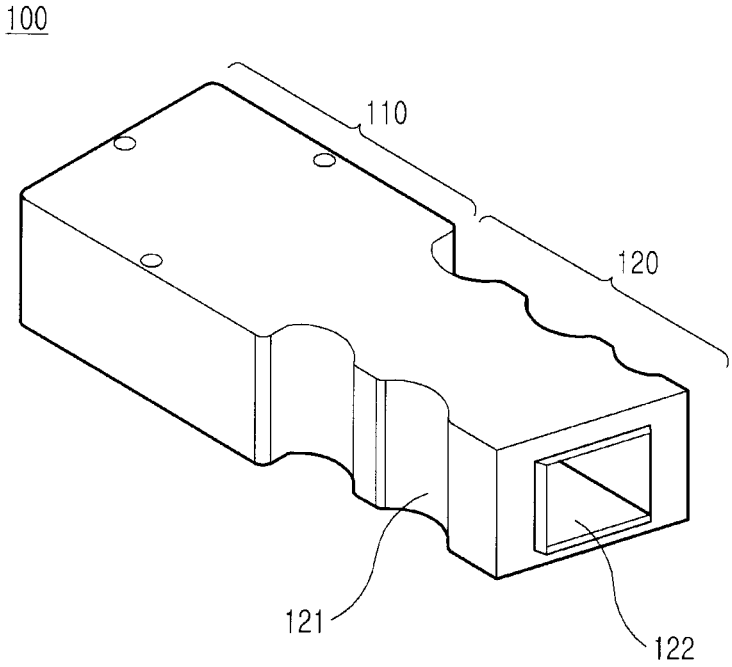
FIG. 1 is a perspective view illustrating a microphone rubber apparatus for a portable communication device according to an exemplary embodiment of the present invention.
Figure 2:
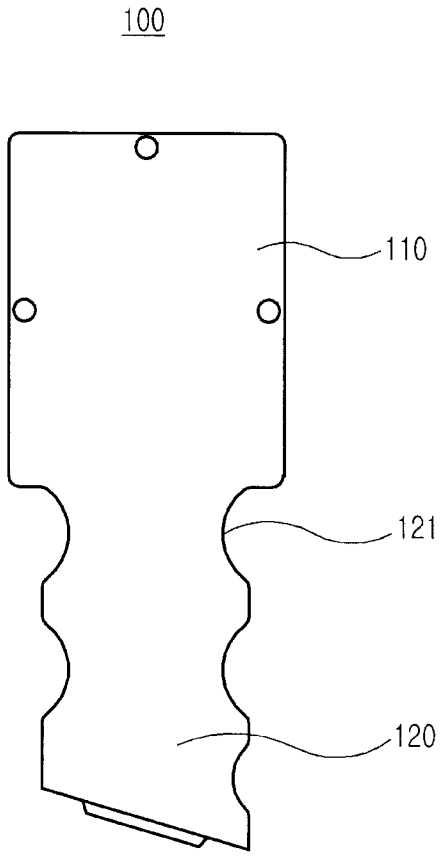
FIG. 2 is a top view illustrating a top surface of a microphone rubber apparatus for a portable communication device according to an exemplary embodiment of the present invention.

Exemplary embodiments of the present invention will now be described in detail with reference to the accompanying drawings.

As illustrated in FIGS. 1 to 4, a microphone rubber apparatus for a portable communication device 10 includes a microphone rubber 100, which is made of an elastic material such as rubber. The microphone rubber 100 includes a microphone holder portion 110, and a connection portion 120, around which at least one shock absorbing portion 121 is formed.

The microphone holder portion 110 is formed to engage with and wrap up a microphone 11, and the connection portion 120 is formed to protrude to one side of the microphone holder portion 110 to deliver a transmission sound to the microphone 11. The at least one shock absorbing portion 121 is deformably formed around the connection portion 120 to mitigate a shock caused by an external force.

Figure 3:
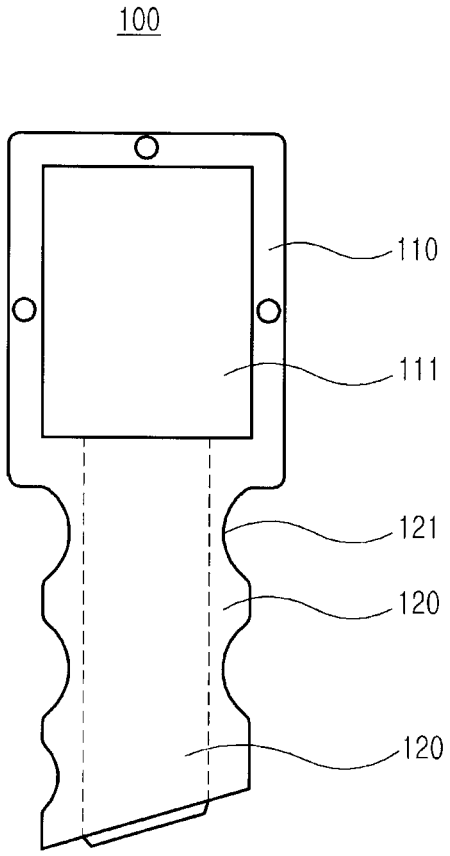
FIG. 3 is a bottom view illustrating a bottom surface of a microphone rubber apparatus for a portable communication device according to an exemplary embodiment of the present invention.

As illustrated in FIG. 3, a coupling groove 111 is formed on one side of the microphone holder portion 110 to fit the microphone 11 into the coupling groove 111. A sound-transmitting hole 122 is formed to connect with the coupling groove 111, passing through the connection portion 120. When the microphone rubber 100 is mounted on the microphone 11, the microphone 11 is fit into the coupling groove 111, and the sound-transmitting hole 122 is face-to-face connected to a microphone hole 12 which is formed on one end of the portable communication device 10.

Referring to FIGS. 1 to 4, the shock absorbing portion 121 includes at least one recess 121. The recesses 121 are connected to each other and formed along both side surfaces of the connection portion 120 so as to absorb an impact applied to a side of the microphone holder portion 110 wrapping the microphone 11 when an impact is applied to the portable communication device 10.

Each of the recesses 121, as illustrated in FIGS. 1 to 4, is formed in a shape of a concave groove having a specific curvature.

Figure 4:
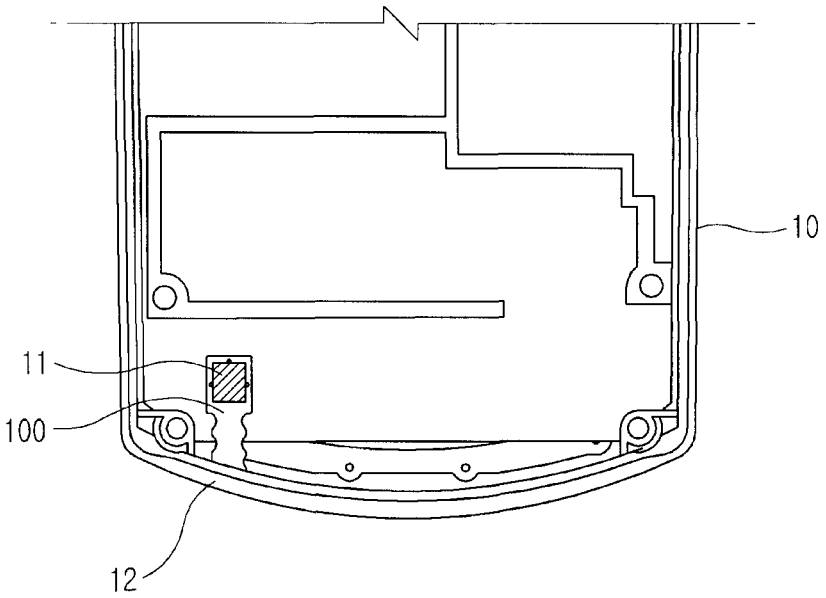
FIG. 4 is a view illustrating a microphone rubber apparatus mounted in one end of a portable communication device according to an exemplary embodiment of the present invention.

As illustrated in FIG. 4, when an impact is applied to the microphone rubber 100 in a specific direction, elastic deformation of extension and compression occurs between the recesses 121 along the impact direction, preventing detachment of the microphone holder portion 110 engaged with the microphone 11.

With reference to FIGS. 1 to 4, a detailed description will now be made of an operation of the microphone rubber apparatus for the portable communication device 10 according to an exemplary embodiment of the present invention.

As illustrated in FIGS. 1 to 4, the microphone 11 is mounted on a printed circuit board to deliver a transmission sound provided through the microphone hole 12 formed in one end of the portable communication device 10.

The microphone rubber 100, as illustrated in FIG. 4, collects or picks up a transmission sound and delivers it to the microphone 11. In addition, the microphone rubber 100 wraps up the microphone 11 to prevent vibration of the microphone 11 and absorb a shock by the external force. The microphone rubber 100 is formed extending from the microphone 11 to the microphone hole 12. Because the microphone rubber 100 is elastic, the microphone 11 can be smoothly fit into the coupling groove 111 in the microphone holder portion 110 by the elasticity. The microphone rubber 100 is preferably made of an elastic material such as a rubber material. The coupling groove 111 is preferably formed equal to or smaller than a size of the microphone 11 according to elasticity of the microphone rubber 100 so as to keep the installation of the microphone rubber 100 on the microphone 11 and to prevent possible detachment of the microphone rubber 100 from the microphone 11 due to the external impact and the like.

When the microphone 11 is fit into the microphone holder portion 110, the connection portion 120 is engaged with the microphone hole 12 on the portable communication device 10, and the sound-transmitting hole 122 connects the microphone hole 12 to the microphone 11.

The shock absorbing portion 121, as illustrated in FIG. 4, is formed on both side surfaces of the connection portion 120, and the recesses 121 formed in a shape of a concave groove having a specific curvature are connected to each other and formed in a wrinkled shape along one end of the microphone rubber 100. When an external force such as an impact is applied to the portable communication device 10, elastic deformation of extension and compression occurs between the recesses 121 formed in a wrinkled shape around the connection portion 120 according to the external force, thereby absorbing the impact and preventing the external force from being delivered to the microphone 11.

In sum, because the wrinkled recesses 121 are deformed according to the external impact applied to the portable communication device 10 or the impact generated during the distribution test, the microphone rubber 100 can ease the impact delivered to the microphone 11 and prevent its possible detachment from the microphone 11.

As is apparent from the foregoing description, because a microphone rubber apparatus for a portable communication device according to the present invention includes a shock absorbing portion around a connection portion of a microphone rubber, recesses of the shock absorbing portion on the microphone rubber can be elastically deformed no matter in which direction the impact is applied to the portable communication device, thereby mitigating the impact. In addition, the microphone rubber can be prevented from being departed from the microphone when an impact is applied to the portable communication device or during the distribution test with the microphone closely adhering to the microphone rubber, thereby contributing to an increase in reliability of the microphone rubber.

While the invention has been shown and described with reference to a certain exemplary embodiments thereof, it will be understood by those skilled in the art that various changes in form and details may be made therein without departing from the spirit and scope of the invention as defined by the appended claims and their equivalents. Although, for example, two wrinkled recesses 121 are shown in the drawings, the number of the wrinkled recesses 121 is subject to change.

What is claimed is:

1. A microphone rubber apparatus for a portable communication device, comprising:

a microphone holder portion within the portable communication device, the microphone holder portion being formed to engage with and wrap up a microphone;

a connection portion protruding to one side of the microphone holder portion;

only one sound transmission hole, the only one sound transmission hole of the microphone rubber apparatus being formed continuously from the microphone holder throughout a length of the connection portion, the only one sound transmission hole permitting sound to travel therethrough and reach the microphone on the microphone holder; and at least one shock absorbing portion deformably formed around the connection portion to ease an impact caused by an external force.

2. The microphone rubber apparatus of claim 1, further comprising:

a coupling groove formed in one side of the microphone holder portion to fit the microphone thereinto; and a sound-transmitting hole formed to extend from one end of the connection portion to the coupling groove, passing through the connection portion;

wherein the microphone is fit into the coupling groove and the sound-transmitting hole is face-to-face connected to a microphone hole formed on one end of the portable communication device.

3. The microphone rubber apparatus of claim 1, wherein the shock absorbing portion includes a plurality of recesses connected to each other and formed along at least a pair of side surfaces of the connection portion so as to absorb an impact applied to the microphone holder portion that wraps up the microphone.

4. The microphone rubber apparatus of claim 3, wherein each of the recesses is formed in a shape of a concave groove having a specific curvature.

5. The microphone rubber apparatus of claim 4, wherein when the impact is applied to the microphone rubber apparatus in a specific direction, elastic deformation of extension and compression occurs between the recesses along the impact direction, preventing detachment of the microphone holder portion engaged with the microphone.

6. The microphone rubber apparatus of claim 1, wherein each of the microphone holder portion, the connection portion, and the at least one shock absorbing portion are composed of rubber.

7. A microphone protection apparatus for a portable communication device, comprising:

a microphone holder portion within the portable communication device, the microphone holder portion formed to engage with and wrap up a microphone;

a connection portion protruding to one side of the microphone holder portion;

only one sound transmission hole, the only one sound transmission hole of the microphone rubber apparatus being formed continuously from the microphone holder throughout a length of the connection portion, the only one sound transmission hole permitting sound to travel therethrough and reach the microphone on the microphone holder; and at least one shock absorbing portion deformably formed around the connection portion and extending along a longitudinal length of the connection portion, with the at least one shock absorbing portion including:

a plurality of protrusions spaced apart and formed along the longitudinal length of exterior surfaces of the connection portion, with the protrusions forming a plurality of recesses therebetween with the recesses extending along the longitudinal length of the connection portion, with the protrusions and recesses configured to absorb an impact applied to the microphone holder portion to ease the impact caused by an external force, thereby protecting the microphone from the external force.

8. The microphone protection apparatus of claim 7, further comprising:

a coupling groove formed in one side of the microphone holder portion to fit the microphone thereinto; and a sound-transmitting hole formed to extend from one end of the connection portion to the coupling groove, passing through the connection portion;

wherein the microphone is fit into the coupling groove and the sound-transmitting hole is face-to-face connected to a microphone hole formed on one end of the portable communication device.

9. The microphone protection apparatus of claim 7, wherein each of the recesses is formed in a shape of a concave groove having a specific curvature.

10. The microphone protection apparatus of claim 9, wherein when the impact is applied to the microphone protection apparatus in a specific direction, elastic deformation of extension and compression occurs between the recesses along the impact direction, preventing detachment of the microphone holder portion engaged with the microphone.

11. The microphone protection apparatus of claim 7, wherein each of the microphone holder portion, the connection portion, and the at least one shock absorbing portion are composed of rubber.

* * * * *